US006027670A

United States Patent [19]

Otani et al.

[11] Patent Number: 6,027,670

[45] **Date of Patent: *Feb. 22, 2000**

[54] RARE EARTH HEXABORIDE ELECTRON-EMITTING MATERIAL

[75] Inventors: Shigeki Otani; Ryutaro Soda; Yoshio Ishizawa, all of Tsukuba, Japan

[73] Assignee: National Institute for Research in Inorganic Materials, Tsukuba, Japan

[ * ] Notice: This patent is subject to a terminal disclaimer.

[21] Appl. No.: 09/105,204

[22] Filed: Jun. 26, 1998

Related U.S. Application Data

[63] Continuation of application No. 08/707,071, Sep. 3, 1996, Pat. No. 5,837,165.

[30] Foreign Application Priority Data

Dec. 21, 1995 [JP] Japan ..... 7-349891

[51] Int. Cl.[7] ..... H01B 1/06; H01J 1/05

[52] U.S. Cl. ..... 252/519.14; 252/521.1; 252/521.4; 313/311; 313/346 R

[58] Field of Search ..... 252/519.14, 521.1, 252/521.4; 423/276, 289; 429/218; 313/311, 346 R

[56] References Cited

U.S. PATENT DOCUMENTS

| | | | |
|---|---|---|---|
| 4,030,963 | 6/1977 | Gibson et al. | 156/602 |
| 4,999,176 | 3/1991 | Iltis et al. | 423/289 |
| 5,238,527 | 8/1993 | Otani et al. | 156/615 |
| 5,336,362 | 8/1994 | Tanaka et al. | 117/42 |
| 5,690,732 | 11/1997 | Otani et al. . | |

FOREIGN PATENT DOCUMENTS 55-140715 11/1980 Japan .

OTHER PUBLICATIONS

Davis et al "Comparison of Thermionic Cathode Parameters of Low Index Single Crystal Faces of $LaB_6$, $CeB_6$ And PrB", Applied Surface Science 37, 1989, pp. 381–94.

Surface Science 107, L.W. Swanson, et al, "Crystallographic Dependence of the Work Function and Volatility of $LaB_6$", pp. 263–289, 1981.

Journal of Physics E: Scientific Instruments 1975 vol. 8, E.D. Gibson et al, "The Preparation of Single Crystal $LaB_6$ Cathodes for Electron Microscopes", pp. 1003–1004.

The Journal of Physical Chemistry, vol. 82, No. 1, 1978, Edmund Storms, et al, "Phase Relationship, Vaporization, and Thermodynamic Properties of the Lanthanum–Boron System", pp. 51–59.

Journal of Crystal Growth 118 (1992), Shigeki Otani, et al Preparation of $LaB_6$ Single Crystals by the Traveling Colvent Floating Zone Method:, pp. 461–463.

Journal of Crystal Growth 126 (1993), Shigeki Otani, et al "Preparation of $LaB_6$, Single Crystals from a Boron–Rich Molten Zone by the Floating Zone Method", pp. 466–470.

Journal of Materials Science 21 (1986), Paul R. Davis, et al "Fabrication and Characterization of Rare Earth Hexaboride Single–Crystal Materials", pp. 825–836.

Prog. Crystal Growth and Charact. 1988, vol. 16, pp. 1–18, Takaho Tanaka et al "A Survey on the Floating Zone Crystal growth of the Monocarbides of IVa, Va and VlaTransition Metals".

*Primary Examiner*—Mark Kopec
*Attorney, Agent, or Firm*—Oblon, Spivak, McClelland, Maier & Neustadt, P.C.

[57] ABSTRACT

A rare earth hexaboride electron-emitting material of the formula $ReB_{6+x}$, wherein Re is La, Ce or (La+Ce), and $0.05 \leqq x \leqq 0.20$.

14 Claims, 1 Drawing Sheet

RARE EARTH HEXABORIDE ELECTRON-EMITTING MATERIAL

This application is a Continuation of application Ser. No. 08/707,071, filed on Sep. 3, 1996, now U.S. Pat. No. 5,837,165.

BACKGROUND OF THE INVENTION

1. Field of the Invention

The present invention relates to a rare earth hexaboride electron-emitting material. More particularly, the present invention relates to a rare earth hexaboride electron-emitting material having long life, which is useful as high intensity thermion emitting material to be used for a scanning electron microscope or an electron image-drawing device.

2. Discussion of Background

Heretofore, single crystals of $LaB_6$ and $CeB_6$ have been used as long lasting high intensity thermion emitting materials for electron microscopes or electron image-drawing devices. Further, a (La, Ce)$B_6$ single crystal as their solid solution, is likewise known to be an excellent electron-emitting material.

Even for such electron-emitting materials having excellent performance, further improvement in their performance have been required in recent years. Particularly, it is desired to develop a thermion emitting material having higher intensity and longer life for a high intensity thermion emitting material.

SUMMARY OF THE INVENTION

Accordingly, it is an object of the present invention to improve the electron-emitting properties of such $LaB_6$, (La, Ce)$B_6$ and $CeB_6$ hot cathode materials and to provide a thermion emitting material having higher intensity and long useful life.

To accomplish such an object, the present invention provides a thermion-emitting cathode material having a long useful life consisting essentially of a hexaboride of the formula $ReB_{6+x}$, wherein Re is La, Ce or (La+Ce), and $0.05 \leqq x \leqq 0.20$.

DETAILED DESCRIPTION OF THE PREFERRED EMBODIMENTS

Figure 1:
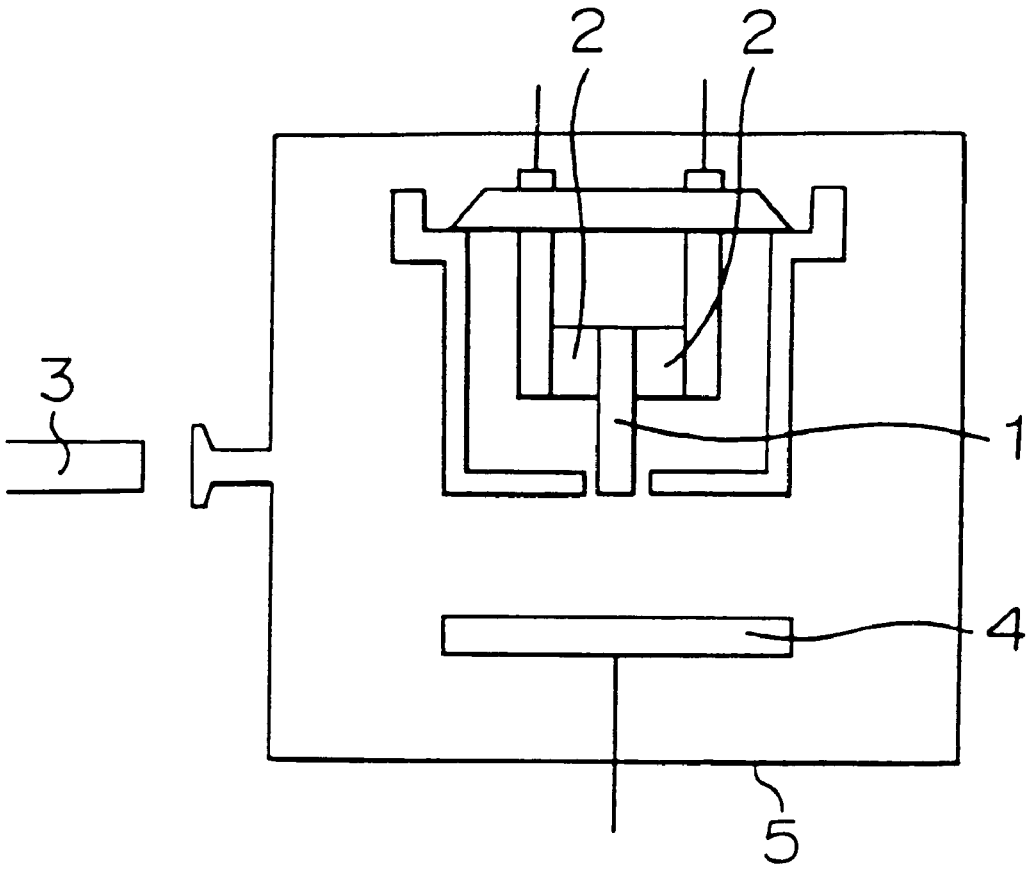
FIG. 1 is a diagrammatical view of an apparatus for evaluating the electron-emitting properties of the rare earth hexaboride electron-emitting material of the present invention, wherein reference numeral 1 indicates a hexaboride single crystal sample, numeral 2 graphite blocks, numeral 3 a photo-thermometer, numeral 4 an anode plate, and numeral 5 a vacuum container.

The rare earth hexaboride electron-emitting material of the present invention employs a hexaboride having a composition wherein boron is excessive (i.e. atomic ratio of boron/metal=6.05 to 6.20), as mentioned above, whereby the properties as elecrtron-emitting cathode material, particularly the properties relating to useful life, are excellent as compared with hot cathodes employing conventional boride crystals having a stoichiometric composition.

The electron-emitting material having the above specific composition can be obtained by growing a single crystal, for example, by a floating zone method. In such a case, the single crystal can be grown by using a starting material rod having a boron content larger than the stoichiometric composition of $ReB_6$.

Now, the embodiments of the present invention will be described in further detail with reference to Examples. However, it should be understood that the present invention is by no means restricted to such specific Examples.

EXAMPLES

By a floating zone method, $LaB_6$, (La, Ce)$B_6$ and $CeB_6$ crystals having the respective stoichiometric compositions, and single crystals of the present invention having compositions in which boron was excessive, were grown.

The single crystals having compositions in which boron was excessive, were grown as follows.

Namely, firstly together with boron powder, $LaB_6$ powder, $CeB_6$ powder or a powder mixture of $LaB_6$ and $CeB_6$ (a molar ratio of 7:3) was filled into a rubber bag having a diameter of 10 mm to form a cylindrical shape, which was then pressed by a rubber press (2,000 kg/cm$^2$) to obtain a compacted powder. This compacted powder was heated in vacuum at 1,800° C. to obtain a sintered rod having a diameter of 9 mm and a length of 12 cm.

The obtained boron-containing starting material sintered rod was set via holder on an upper shaft of a floating zone growing apparatus, and on a lower shaft, a rare each boride sintered rod was set via a holder.

Then, the boron-containing starting material sintered rod and the rare earth boride sintered rod were heated and melted to bond to each other. Then, the boron-containing starting material sintered rod was moved 5 cm upward to form an initial melt zone. Then, upper and lower shafts were slowly moved downward to let a single crystal grow.

Specifically, after filling Ar of 7 atm to a single crystal-growing furnace, the lower end of the rare earth boride sintered rod was melted by a high frequency work coil to form an initial melt zone and then moved downward at a rate of 1 cm/hr. In this manner, a desired single crystal was obtained.

From such a single crystal, a single crystal block having a <100> orientation was cut out and assembled into a cathode, which was then mounted in an apparatus as shown in FIG. 1, whereupon the electron-emitting properties were evaluated.

Referring to FIG. 1, the procedure for evaluating the electron-emitting properties will be described. Firstly, from the single crystal (having a diameter of about 1 cm) prepared by the floating method, a block (1 mm×1 mm×3 mm) was cut out by means of an electrical discharge machine. The compositional analysis of the single crystal block was carried out by means of EPMA using a hexaboride having a proportional composition as the standard substance. The cutout block of the boride single crystal sample (1) was nipped by graphite blocks (2) to form a cathode as shown in FIG. 1. This cathode was set in a vacuum apparatus and heated by letting the graphite blocks (2) generate heat by direct electrical conduction under a highly vacuumed condition of $10^9$ torr, whereupon the electron-emitting properties were measured at a sample temperature within a range of from 1,200 to 1,500° C. and an applied voltage within a range of from 1 to 6 kV. The electron-emitting properties were examined by the relation between the voltage applied across the sample (1) and the anode (4) and the heating temperature of the sample (the operating temperature). The temperature was measured by a photo-thermometer (3). Further, with respect to evaporation from the sample, the evaporated amount was determined from the amount of the sample deposited on the anode by heating for about 700 hours. The data were compared with the electron-emitting properties of the hexaboride single crystal having a stoichiometric composition.

With respect to the electron-emitting properties of the composition of the present invention having a boron-excessive composition, in each case, the temperature for heating the sample required to take out the same emission current at the same accelerating voltage, was higher by about 10° C., but no change in the electron-emitting properties due to the change in composition was observed, as compared with the electron-emitting properties of the hexaboride single crystal having a proportional composition. Further, the evaporation rate at that time was found to be lower by from ½ to 1/10 at an operation temperature within a range of from 1,200 to 1,500° C.

The useful life of a hot cathode depends on the change in the configuration of the forward end of the cathode due to the evaporation during the operation. Accordingly, the decrease in the evaporation rate means that the useful life is expected to be prolonged correspondingly. Further, at a temperature for the same evaporation rate, the boron-excessive crystal can be heated to a temperature higher by from a few tens to 100° C., whereby a larger quantity of emission current can be taken out. It is thereby possible to utilize it as a high intensity hot cathode material.

Table 1 shows the temperatures of samples at which the emission current density became $2A/cm^2$ at an accelerating voltage of 6 kV. When the composition became boron-excessive as compared with the proportional composition, it was necessary to increase the heating temperature by about 10° C., but substantially the same electron-emitting properties were obtained.

On the other hand, Table 2 shows the evaporation rates, whereby it is evident that with the boron-excessive composition of the present invention, the evaporation rate is lower by from ½ to 1/10 than with the proportional composition, thus indicating that the material of the present invention is useful as a long lasting cathode material.

TABLE 1

| | |
|---|---|
| $LaB_6$ | 1302 |
| $LaB_{6.07}$ | 1311 |
| $LaB_{6.18}$ | 1316 |
| $CeB_6$ | 1322 |
| $CeB_{6.07}$ | 1330 |
| $CeB_{6.14}$ | 1334 |
| $(La_{0.7}Ce_{0.3})B_6$ | 1314 |
| $(La_{0.7}Ce_{0.3})B_{6.1}$ | 1320 |
| | (° C.) |

TABLE 2

| Temperature | 1300° C. | 1500° C. |
|---|---|---|
| $LaB_6$ | $5 \times 10^{-3}$ | $2 \times 10^{0}$ |
| $LaB_{6.07}$ | $6 \times 10^{-4}$ | $1 \times 10^{0}$ |
| $CeB_6$ | $1 \times 10^{-3}$ | $7 \times 10^{-1}$ |
| $CeB_{6.14}$ | $6 \times 10^{-4}$ | $4 \times 10^{-1}$ |

(μm/100hr)

As described in detail in the foregoing, the electron-emitting material of the present invention consisting essentially of a hexaboride having a composition in which boron is excessive (atomic ratio of boron/metal=6.05 to 6.20), is excellent in the properties as an electron-emitting cathode material, particularly in the properties relating to the useful life, as compared with hot cathodes employing conventional boride crystals having a proportional composition. Therefore, it is useful as a high intensity thermion-emitting material for a scanning electron microscope or an electron image-drawing device.

What is claimed is:

1. In a method for emitting electrons comprising heating and applying a voltage to an electron-emitting material, the improvement comprising selecting as the electron-emitting material a rare earth hexaboride of the formula $ReB_{6+x}$, wherein Re is Ce or a mixture of La and Ce, and $0.05 \leqq x \leqq 0.18$.

2. In a method for making an electron emitter comprising selecting an electron-emitting material, the improvement comprising selecting as the electron-emitting material a rare earth hexaboride of the formula $ReB_{6+x}$, wherein Re is Ce or a mixture of La and Ce, and $0.05 \leqq x \leqq 0.18$.

3. The method of claim 1, wherein $0.07 \leqq x \leqq 0.18$.

4. The method of claim 1, wherein $0.1 \leqq x \leqq 0.18$.

5. The method of claim 1, wherein $0.1 \leqq x \leqq 0.14$.

6. The method of claim 1, wherein Re is Ce.

7. The method of claim 2, wherein $0.07 \leqq x \leqq 0.18$.

8. The method of claim 2, wherein $0.1 \leqq x \leqq 0.18$.

9. The method of claim 2, wherein $0.1 \leqq x \leqq 0.14$.

10. The method of claim 2, wherein Re is Ce.

11. An electron emitter prepared by the method of claim 2.

12. The electron emitter of claim 11, wherein Re is a mixture of La and Ce.

13. The electron emitter of claim 11, wherein $0.1 \leqq x \leqq 0.18$.

14. The electron emitter of claim 11, wherein $0.1 \leqq x \leqq 0.14$, and Re is Ce.

* * * * *